US007385151B2

(12) United States Patent
Lipp et al.

(10) Patent No.: US 7,385,151 B2
(45) Date of Patent: Jun. 10, 2008

(54) CAMSTACK TIMER WITH MOMENTARY START SWITCH

(75) Inventors: Ellis Paul Lipp, Charlottesville, IN (US); David E. Zink, Greenwood, IN (US); Benjamin Franklin Chestnut, Avon, IN (US)

(73) Assignee: Emerson Electric Co., St. Louis, MO (US)

( * ) Notice: Subject to any disclaimer, the term of this patent is extended or adjusted under 35 U.S.C. 154(b) by 87 days.

(21) Appl. No.: 11/472,702

(22) Filed: Jun. 22, 2006

(65) Prior Publication Data

US 2007/0295589 A1 Dec. 27, 2007

(51) Int. Cl.
*H01H 43/00* (2006.01)

(52) U.S. Cl. ..... 200/38 R; 200/38 A

(58) Field of Classification Search ..... 200/38 A, 200/38 B, 38 C, 38 CA, 38 BA, 38 R, 33 R, 200/37 A, 38 F, 38 FA, 38 FB, 35 R
See application file for complete search history.

(56) References Cited

U.S. PATENT DOCUMENTS

| | | | | |
|---|---|---|---|---|
| 4,146,760 | A | 3/1979 | Voland | |
| 4,292,482 | A * | 9/1981 | Smock et al. | 200/38 R |
| 4,307,270 | A | 12/1981 | Smock | |
| 4,538,037 | A * | 8/1985 | Amonett | 200/38 R |
| 4,604,504 | A | 8/1986 | Stout et al. | |
| 4,748,296 | A | 5/1988 | Cutler et al. | |
| 4,796,484 | A | 1/1989 | Eder | |
| 4,892,982 | A | 1/1990 | Hueber et al. | |
| 5,030,801 | A | 7/1991 | Amonett | |
| 6,583,371 | B1 | 6/2003 | Sokalski et al. | |
| 6,779,942 | B2 | 8/2004 | Lipp et al. | |
| 6,838,628 | B2 * | 1/2005 | Amonett et al. | 200/300 |

* cited by examiner

*Primary Examiner*—Elvin Enad
*Assistant Examiner*—Marina Fishman
(74) *Attorney, Agent, or Firm*—Maginot, Moore & Beck

(57) ABSTRACT

A device enables a camstack in an appliance timer to be rotated without applying electrical power to the switches of the appliance. The device includes a knob having an elongated actuator extending from a lower surface of the knob to an outboard end, the elongated actuator having a shoulder between the outboard end of the elongated actuator and the knob, a camstack shaft for rotating a camstack used to selectively engage cam followers for controlling operation of an appliance cycle, the camstack shaft including a passageway for telescopically receiving the elongated actuator extending from the knob, a switch actuator having a hub and a radial flange, the hub having a passageway for receiving the outboard end of the elongated actuator up to the shoulder so the actuator is axially moved by depression of the knob, a switch having one contact mounted on one end of a resilient member configured to urge the one contact toward another contact to close the switch, and a slider having a first end and a second end, the first end of the slider contacting the radial flange of the switch actuator and the second end of the slider being coupled to the resilient member of the switch so that depression of the knob moves the radial flange of the switch actuator with respect to the first end of the slider to urge the resilient member and the one contact away from the other contact to open the switch.

16 Claims, 6 Drawing Sheets

CAMSTACK TIMER WITH MOMENTARY START SWITCH

TECHNICAL FIELD

The present disclosure relates generally to camstack timers, and, more particularly, to a camstack timer that incorporates a momentary start switch to initiate operation of an appliance.

BACKGROUND

Camstack timers have been used in many household appliances, such as dishwashers, clothes washers, clothes dryers, etc. These timers control the operational cycles of appliances by opening and closing switches to start and stop various motors, actuate various valves, and illuminate indicators. The switches ("camstack switches") are actuated and de-actuated as a timer motor turns a camstack, which is a cylindrical structure having undulations in its circumference. These undulations act as cams that move cam followers riding against the circumference of the camstack. The movements of these cam followers under the influence of the cam surfaces on the camstack result in the opening and closing of switches in switch assemblies. These switches, in turn, determine whether electrical current is applied to the motors, actuators, values, and indicators of the appliance.

To orient the camstack to an appropriate position to perform an operational cycle for the appliance, the camstack typically includes a shaft that extends beyond the surface of a control panel where a knob is mounted to the shaft. The knob usually includes an index mark that can be aligned with cycle indicia located on the control panel about the knob. Typically, the knob is rotated so the knob index is aligned with the cycle indicia that the operator wants the appliance to perform and then the appliance is activated. The timer motor then begins to rotate the camstack to operate the motors, actuators, valves, and indicators of the appliance to perform the selected cycle.

Manual rotation of the control knob to the position for selecting a cycle may adversely affect the components of the timer. For example, if electrical line power is available for application to the camstack switches by the interaction of the cams on the camstack and the cam followers, the switch contacts may experience damage from arcing as the contacts are closed and opened quickly. To address this risk of damage, some appliances have included dedicated manually operated line switches that are separate from the camstack timers. These separate line switches are manually moved by the operator to disconnect electrical line power from the timer switch assemblies before the control knob is rotated to the desired start position. Once the initial position is reached, the switch is moved to reapply electrical line power to the timer. However, operator error may result in the separate line switches not being used before the control knob is rotated to a position for cycle commencement.

More recently, U.S. Pat. No. 4,146,760 to Voland ("Voland") discloses, among other things, a camstack timer including a line switch such that alternative manual axial indexing of a control knob can alternatively open and close the line switch, while the camstack setting can still be manually adjusted by rotating the same control knob. Also, U.S. Pat. No. 4,892,982 to Hueber et al. discloses a timer mechanism with an improved clutch assembly. The device disclosed in this patent also includes a switch actuator that selectively disengages a set of electrical contacts based on axial position of a shaft within the camstack structure. This structure, however, requires operator movement of the shaft to both engage and disengage the electrical contacts. Additionally, the switch actuator is not fixedly linked to the contacts. Consequently, slippage and wear over time may result in the contacts becoming close enough to arc even though the shaft is in position to disengage the electrical contacts.

SUMMARY

A device enables a camstack in an appliance timer to be rotated without applying electrical power to the switches of the appliance. The device includes a knob having an elongated actuator extending from a lower surface of the knob to an outboard end, the elongated actuator having a shoulder between the outboard end of the elongated actuator and the knob, a camstack shaft for rotating a camstack used to selectively engage cam followers for controlling operation of an appliance cycle, the camstack shaft including a passageway for telescopically receiving the elongated actuator extending from the knob, a switch actuator having a hub and a radial flange, the hub having a passageway for receiving the outboard end of the elongated actuator up to the shoulder so the actuator is axially moved by depression of the knob, a switch having one contact mounted on one end of a resilient member configured to urge the one contact toward another contact to close the switch, and a slider having a first end and a second end, the first end of the slider contacting the radial flange of the switch actuator and the second end of the slider being coupled to the resilient member of the switch so that depression of the knob moves the radial flange of the switch actuator with respect to the first end of the slider to urge the resilient member and the one contact away from the other contact to open the switch. The coupling of the slider to the resilient member reduces the likelihood of wear that may enable arcing between the contacts over time.

A method for running an apparatus on alternating current power, includes operatively coupling a normally open relay contact between an alternating current source and an electric motor for an appliance timer, operatively coupling a momentary switch between the alternating current source and a relay coil for operating the normally open relay contact, operatively coupling the momentary switch between the alternating current source and the electric motor for the appliance timer, opening the momentary switch to decouple the alternating current source from the electric motor so a camstack may be rotated without applying an alternating current to the electric motor, moving the camstack to a position that begins an operational cycle for the appliance, and closing the momentary switch to power the electric motor for the appliance timer and to energize the relay coil so alternating current is supplied through the relay contact until the camstack interrupts power to the electric motor at termination of the operational cycle.

The above-noted features and advantages, as well as additional features and advantages, may be readily ascertained by those of ordinary skill in the art by upon reference to the following detailed description and the accompanying drawings.

DETAILED DESCRIPTION

Figure 1:
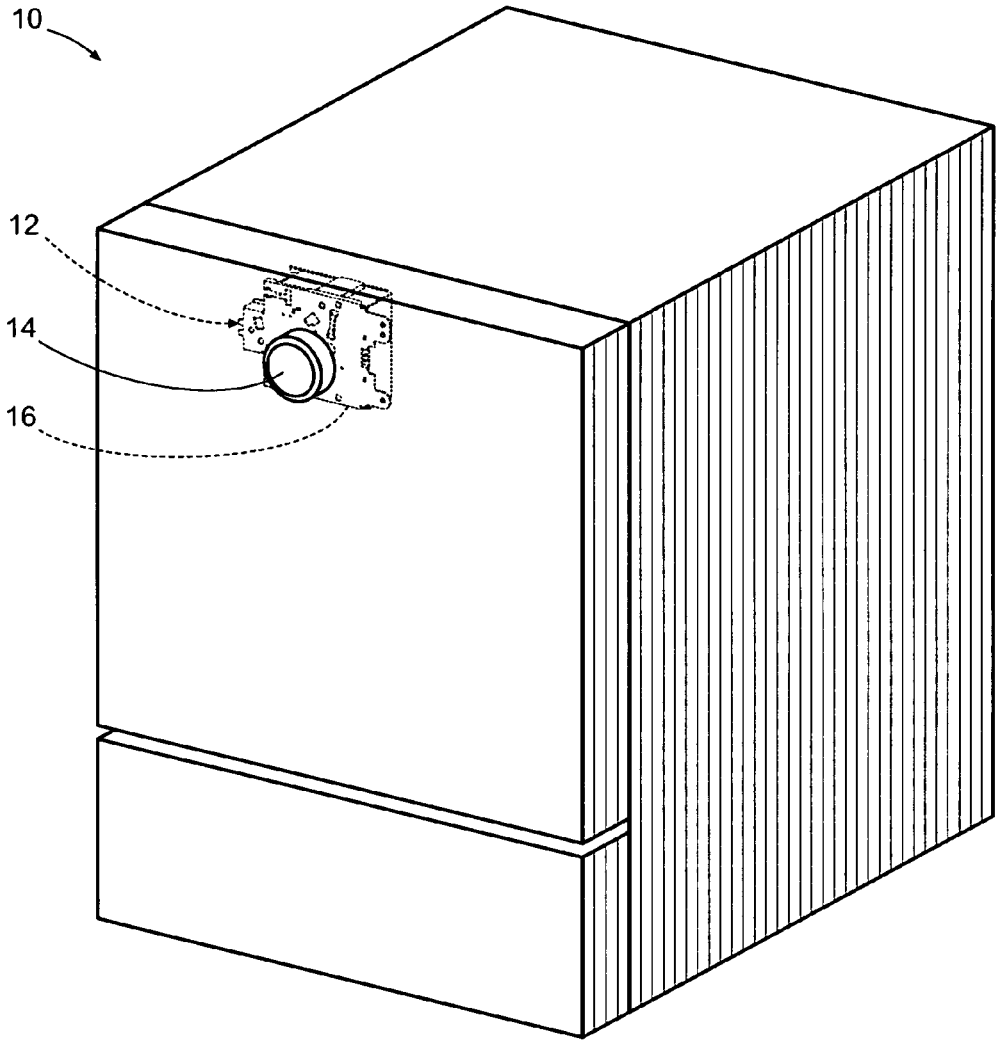
FIG. 1 shows a perspective view of an appliance having a timer with an integral momentary start switch as described herein.

Like reference numerals refer to like parts throughout the following description and the accompanying drawings.

FIG. 1 shows a perspective view of an exemplary household appliance 10. In the exemplary embodiment, appliance 10 is a dishwashing machine. In alternative embodiments, appliance 10 may be a clothes dryer or other household appliance that uses a timer to control operational cycles. Appliance 10 includes an exemplary camstack timer 12 positioned inside appliance 10. Positioning of the camstack within the camstack timer 12 may be achieved with an exemplary control knob 14 positioned outside appliance 10. Knob 14 is fixedly coupled to timer 12 as discussed further below.

Figure 2:
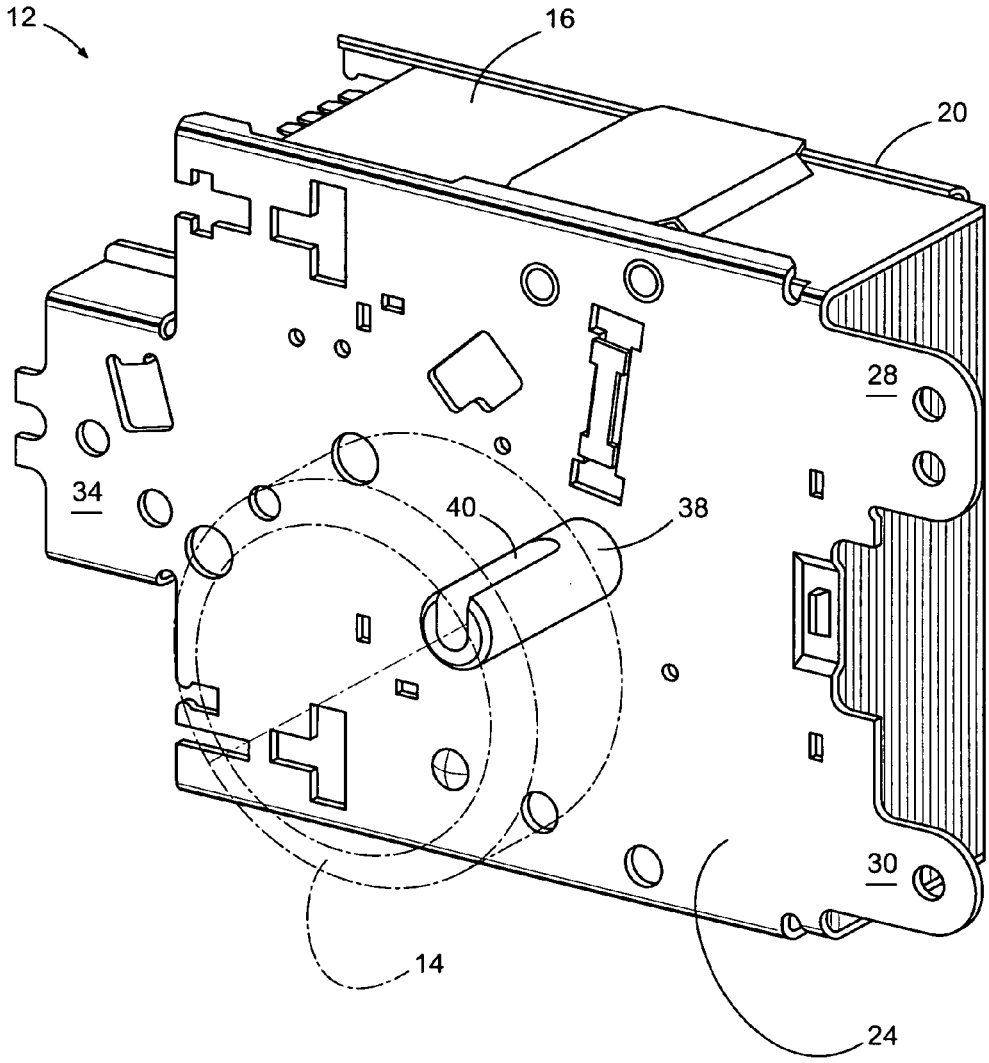
FIG. 2 shows a perspective view of the housing for the timer shown in FIG. 1.

FIG. 2 shows a perspective view of timer 12 with the position of knob 14 depicted in phantom. Timer 12 includes a housing 16 having a back plate 20 and a front plate 24. Mounting tabs 28, 30, and 34 are configured to receive fasteners for securing the housing 16 and the internal components of the timer 12 to the frame of the appliance 10. A camstack shaft 38 extends from the interior volume of the housing 16 through the front plate 24 so a portion of the camstack shaft 38 is exposed forwardly of the front plate 24. The camstack shaft 38 includes a splines 40 to receive an elongated actuator from knob 14 as described in more detail below.

Figure 3A:
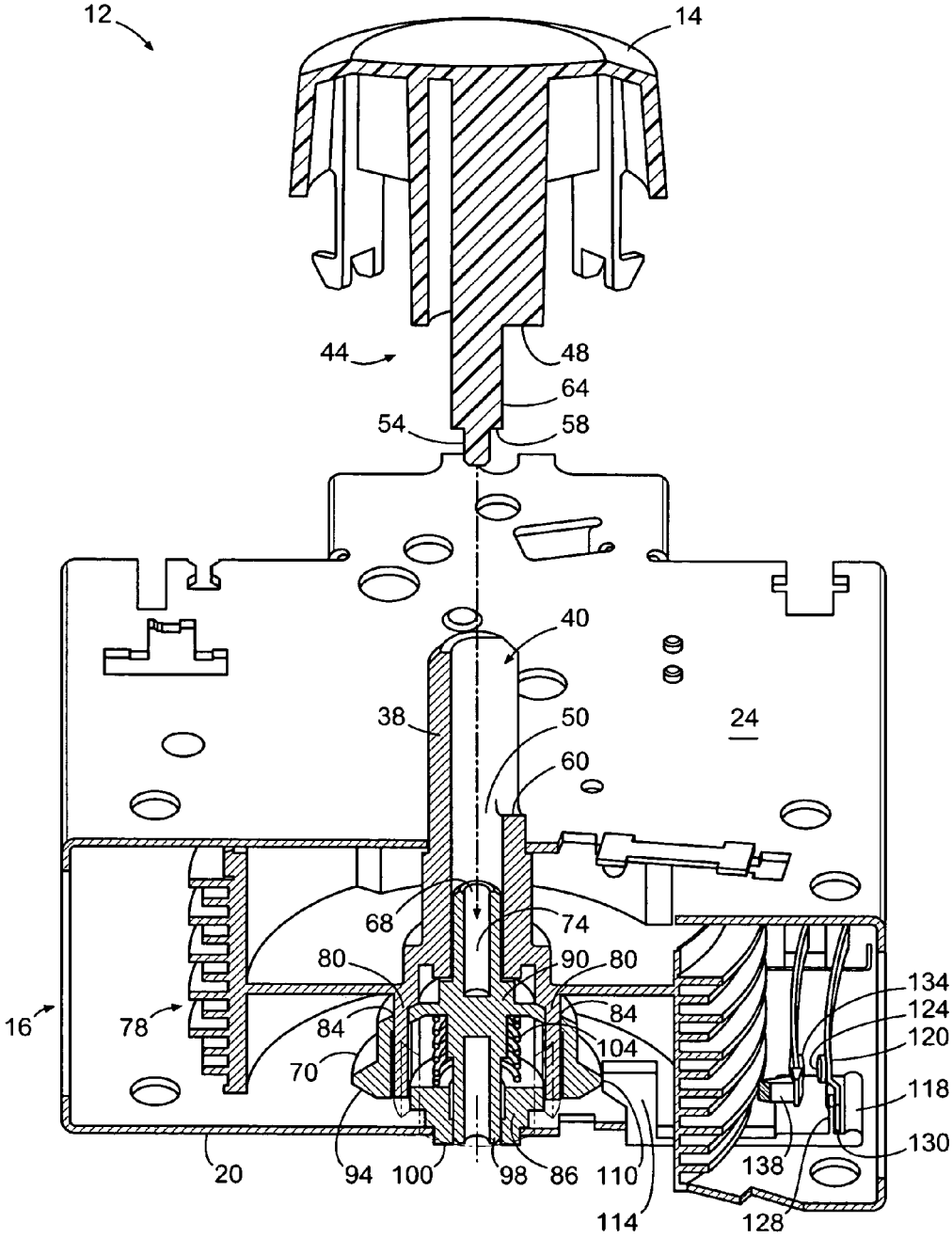
FIG. 3A is a plan side view of the timer showing cross-sectional views of some of the timer components internal to the housing shown in FIG. 2 with the timer in position for rotation of the camstack without applying power to the timer motor.

As shown in FIG. 3A, timer 12 includes the knob 14, the camstack shaft 38, which carries camstack 78, switch actuator 70, biasing member 104, journal bearing 100, slider 114, and electrical switch contacts 124, 134. In brief, the camstack 78 may be rotated while the knob 14 is in the depicted position because the switch actuator 70 holds the slider 114 against the biasing action of the resilient arm 120 so the contacts 124, 134 are separated. This separation interrupts the delivery of electrical power to the switch assemblies for controlling operation of the appliance. Consequently, the camstack may be rotated without the movement of the switches in the switch assemblies causing arcing.

Again, as an overview, appliance operation is commenced by depressing the center of the knob 14 to move the extended actuator 44 axially so the shoulder 58 of the actuator 44 pushes the switch actuator 70 against the urging of the biasing member 104. The biasing member 104 is compressed between a portion of the switch actuator 70 and the journal bearing 100. The downward movement of the switch actuator 70 allows the slider 114 to slip over the flange 94 of the actuator 70 under the urging of resilient arm 120. As a result, the electrical contact 124 coupled to the outboard end of the slider 114 is moved into engagement with the electrical contact 134. In this position, shown in FIG. 3B, the electrical circuit is completed that starts the operation of the appliance. Specifically, the timer motor is activated so the camstack begins to turn and control of the appliance by the camstack commences. Upon release of the actuator 44, the biasing member 104 urges the switch actuator upwardly and the switch actuator returns to the position shown in FIG. 3A, however, the camstack is being turned by the timer motor as a power relay has been latched. Upon the end of the cycle being reached as programmed in the camstack, power is decoupled from the switch assemblies and the knob 14 may be rotated to select another operational cycle without significant risk of arcing the switches.

In more detail and with reference to FIG. 3A, knob 14 includes an elongated actuator 44 that extends from the lower surface of knob 14. Elongated actuator 44 includes a fin 48 which is received within splines 40 for coupling the knob 14 to the camstack shaft 38. Subsequent rotation of the knob 14 causes the elongated actuator 44 to rotate the camstack shaft 38 as well. As shown in FIG. 3A, a portion of the elongated actuator 44 of knob 14 is received in a passageway of 50 of camstack shaft 38. The distal end 54 of the elongated actuator 44 is a continuation of the elongated shaft following shoulder 58. The portion 64 of elongated actuator 44 is sized to fit within the passageway 50 between the termination of splines 40 and the opening 68 in the switch actuator 70. When elongated actuator 44 is properly placed within the splines 40 of camstack shaft 38, the end of the fin 48 lies short of the termination 60 of splines 40, and the shoulder 58 lies short of the opening 68 in switch actuator 70. The distal end 54 of elongated actuator 44 extends through the opening 68 into passageway 74 of switch actuator 70.

With continued reference to FIG. 3A, camstack 78 is integrally formed with camstack shaft 38 so rotation of the shaft 38 also rotates camstack 78. The end of the camstack shaft 38 that nests within the switch actuator 70 includes interlocking legs 80, which are received in apertures 84 of the switch actuator 70. Placement of the interlocking legs 80 within the apertures 84 causes the camstack shaft 38 and the switch actuator 70 to cooperate so the switch actuator rotates when the camstack shaft 38 is rotated by movement of knob 14. The switch actuator 70 includes a switch body 90 and a radial flange 94. The apertures 84 are formed in the radial flange 94 to receive the interlocking legs of camstack shaft 38. The body 90 of switch actuator 70 includes a switch activator shaft 98 that is received within a journal bearing 100, which is mounted in the rear plate 20. Concentrically mounted about the switch actuator shaft 98 is a biasing member 104. Biasing member 104 may be a coiled spring or other type of resilient member. The biasing member 104 is mounted between the radial flange 94 and the journal bearing 100 so downward pressure on the switch actuator body applied by the elongated actuator 44 urges the switch actuator body against the biasing member 104 to compress it. Thereafter, when the downward pressure on the knob is released, the switch actuator body 90 is urged upwardly by compression being released from the biasing member 104 to return the elongated actuator 44 to its original position. Additionally, the elongated actuator 44 may be coupled to the under surface of knob 14 using a resilient webbing or the like to facilitate the return of the elongated actuator 44 to its home position.

Again with reference to FIG. 3A, the radial flange 94 is sloped to a flat edge 110. A push block for the slider 114 mates against the flat edge 110 of the radial flange 94 when the switch actuator 70 is in the position shown in FIG. 3A. In the position shown in the figure, the radial flange 94 has pushed the slider 114 to the right. Coupled at the outboard end 118 of the slider 114 is a resilient member 120. Resilient member 120 carries an electrical contact 124. At the outboard end of resilient member 120 is a tang 128 that frictionally fits within a groove 130 at the outboard end 118 of the slider 114. In this or a similar manner, the outboard end of resilient member 120 is secured to the outboard end of the slider 114. A second electrical contact 134 is supported by a cam follower 138 that rides on a cam of the camstack 78. In the position shown in FIG. 3A, the cam follower 138 is held at a position where it could mate with contact 124, except the slider 114 holds the secured end of resilient member 120 away from the electrical contact 134. In this position, the camstack may be rotated without arcing occurring between the contacts 124 and 134. As described in more detail below, the opening of these contacts also reduces the likelihood of arcing occurring at other contacts within the appliance 10.

At the end of an operational cycle, the cam on which cam follower 138 rides is reduced and the follower moves towards the camstack 78. The movement of the cam follower 138 causes the electrical contact 134 to move sufficiently away from the electrical contact 124 that, even if the biasing member 104 failed to return the switch actuator 70 to the position shown in FIG. 3A, the resilient arm 120 would not be able to move the contact 124 into engagement with the contact 134. Contact 124 would be stopped from engaging the contact 134 by the edge 110 of the radial flange 94 blocking the slider 114 from moving a distance equal to or greater than the distance retreated by the cam follower 138 and the contact 134 at the end of an operational cycle. When the cam follower 138 follows the reduced cam profile at the end of an operational cycle and the switch actuator has returned to the position shown in FIG. 3A, the edge 110 keeps the resilient arm from being able to move a distance that enables contact 124 to engage contact 134. This structure reduces the likelihood that an object, such as a chair, for example, pushing against the knob 14 enables the timer motor to remained energized at the end of an operational cycle. If the timer motor remains energized, the camstack would continue to turn and commence the switch programming for the next operational cycle. Because the cam follower 138 moves to a position that frustrates the ability of the resilient arm 120 to move a sufficient distance to engage the contact 124, the camstack 78 requires manual movement to bring the cam on which cam follower 138 rides to a position where contact 134 is available for engaging contact 124. This requirement helps ensure that a user clears the obstruction depressing knob 14 before continuing to use the appliance 10.

Figure 3B:
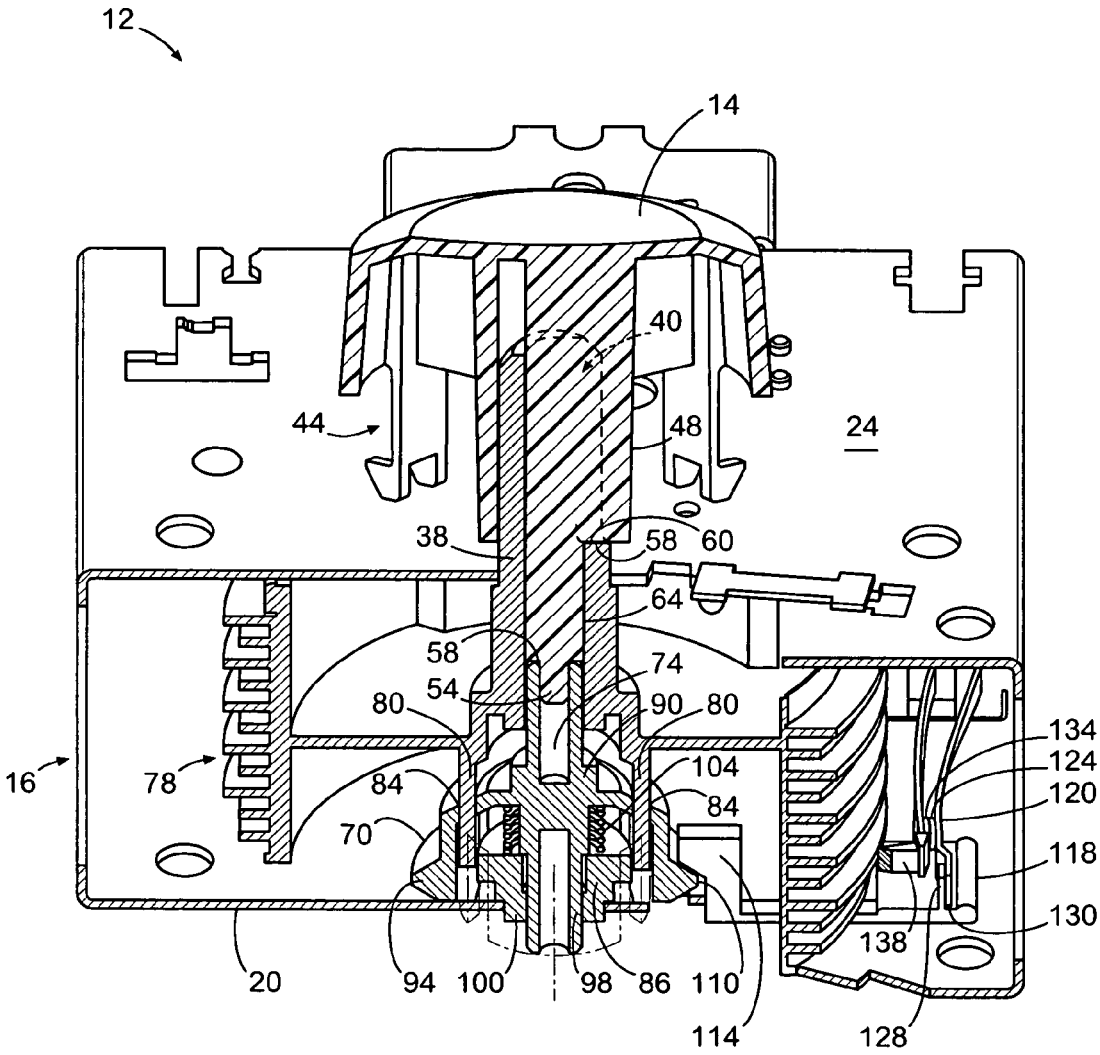
FIG. 3B is a plan side view of the timer showing cross-sectional views of the timer components shown in FIG. 3A with the momentary switch in position to commence operation of the appliance.

FIG. 3B shows the knob 14 being pushed inwardly toward the rear plate 20. In this position, the bottom of fin 48 travels downwardly until it is stopped by edge 60 of splines 40. The shoulder 58 of the elongated actuator 44 also pushes switch actuator 70 against the biasing action of biasing member 104 to compress the biasing member. This movement axially displaces the switch actuator 70 so the edge 110 of the radial flange 94 slides below the pusher block of slider 114 and the pusher block of slider 114 rides along the sloped upper surface of radial flange 94. As the radial flange 94 moves below the pusher block of slider 114, resilient member 120 urges electrical contact 124 into mating with electrical contact 134. The securing of the outboard end of the resilient member 120 to the slider 114 with tang 128 and groove 130 helps ensure positive, controlled movement of the slider 114 along the sloped upper surface of radial flange 94. In this position, electrical current may be supplied through electrical contacts 134, 124 to commence an operational cycle of the appliance 10 as described in more detail below.

Upon release of the knob 114, biasing member 104 urges the body of switch actuator 70 upwardly. This action causes the radial flange 94 to push the pusher block of slider 114 out so the flat edge 110 of the radial flange 94 rests against the pusher block of the slider 114 to hold the slider against the biasing action of resilient member 120. This action disconnects the closing of the start circuit for the appliance 10 by interrupting the electrical connection through the contacts 124, 134. Operation of the commenced cycle for the appliance 10 continues because operational power is provided to the timer motor for rotating the camstack 78 through a latched relay as explained below with reference to FIG. 5.

Figure 4:
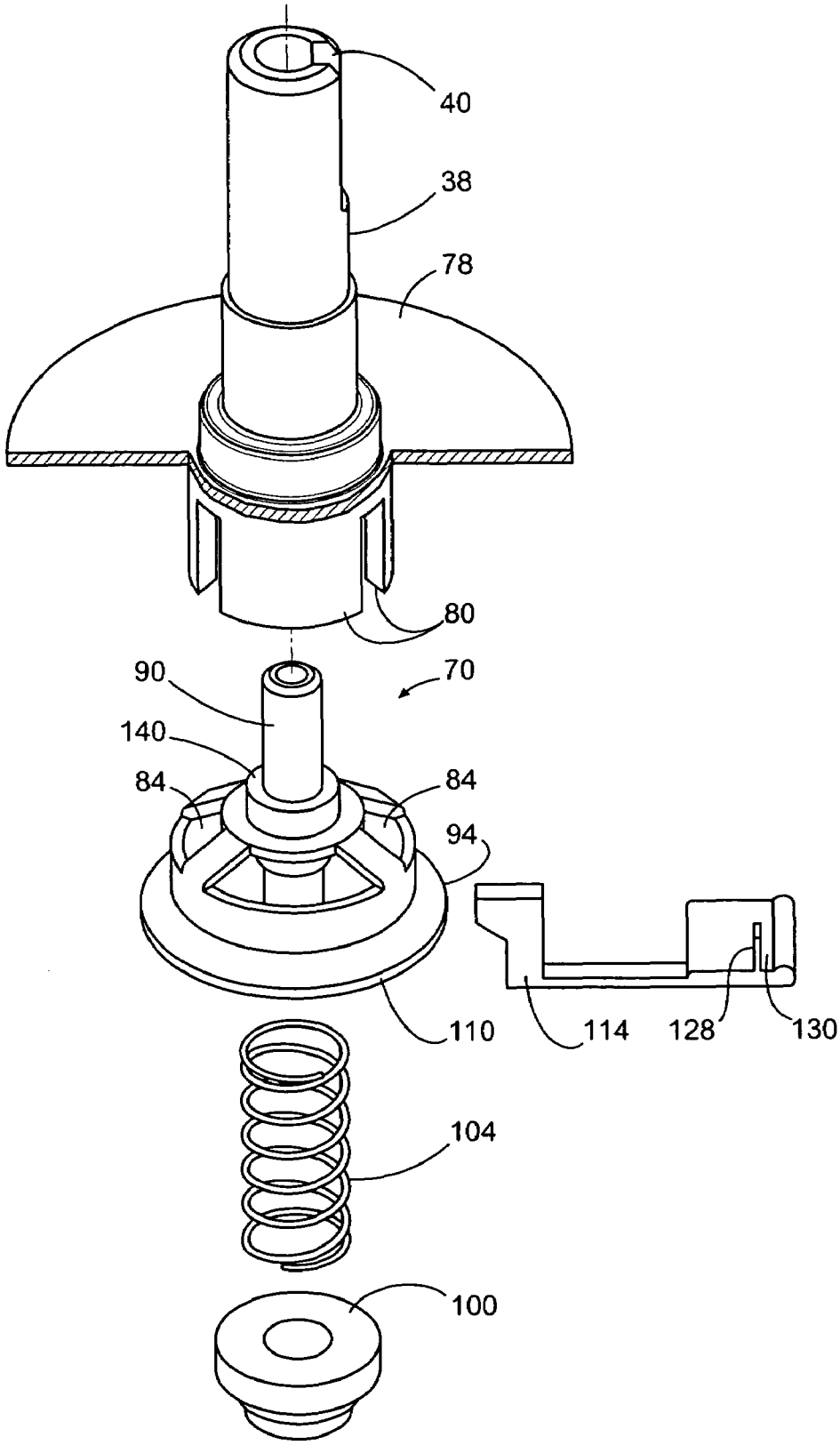
FIG. 4 is an exploded perspective view of the timer components that cooperate to start operation of the appliance.

FIG. 4 shows the main components of the timer 12 that implement the momentary start switch. The camstack shaft 38 shows splines 40 in position to receive the elongated actuator 44 of the knob 14. Mounted about this shaft 38 is the upper cam surface 78. Interlocking legs 80 are shown at the base of the camstack shaft 38. Switch actuator 70 shows the radial flange 94 with its flat edge 110 for mating with the pusher block of slider 114. The shaft of body 90 continues past the hub 140 to rest within the journal bearing 100. Biasing member 104 is shown as a coil spring for being concentrically mounted about the shaft 90 of the switch actuator body. The apertures 84 of the radial flange 94 receive the interlocking legs 80 of the camstack shaft 38 to couple the rotational movement of two components together. The slider 114 includes the groove 130 for securing the outboard end of the resilient member 120 to the slider 114.

Commencement of an operational cycle of the appliance 10 may now be described with reference to FIG. 5. An alternating current source 200 is coupled to a set of door switches 204. These switches reduce the risk that appliance 10 is activated to perform an operational cycle while the doors of the appliance are open. A first circuit leg coupled in series with the upper door switch 204 includes a normally open set of relay contacts 208, a cycle cam switch 210, and a light 214. The cycle cam switch is a switch on the camstack 78 that enables a switch to provide electrical power for operation of the appliance during an operational cycle. This switch is typically closed at the beginning of an operational cycle and opened to terminate the cycle.

Figure 5:
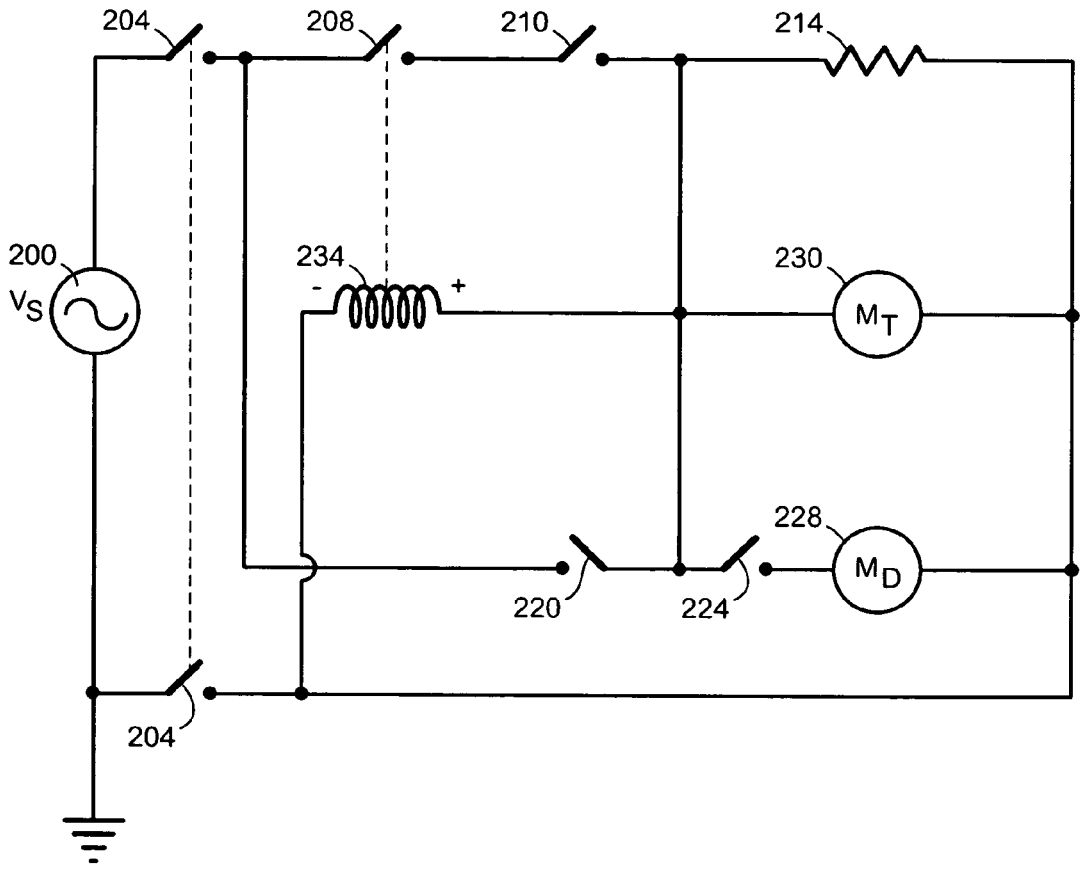
FIG. 5 is an electrical schematic of the timer switches and the electrical motors of the appliance.

Also coupled in series with the upper door switch 204 but in parallel with the first circuit leg shown in FIG. 5 is a second circuit leg that includes a push to start switch 220, a motor cam switch 224 and an electrical drive motor 228. The motor cam switch 224 is a switch on the camstack 78 that selectively opens and closes a switch for providing electrical power to the motors for pumps or sprayer arms, for example, in an appliance. Coupled to and parallel to these two circuit legs is a third circuit leg having the timing motor 230 and the relay coil 234. The three circuit legs are coupled to one another at a point between the cycle cam switch 210 and the light 214 in the first circuit leg, between the coil relay 234 and the timer motor 230 in the third circuit leg, and between the push to start switch 220 and the motor cam switch 224 in the second leg. The push to start switch 220 may be implemented with the same or similar structure described above with reference to the elongated actuator 44, switch actuator 70, slider 114, and the resilient arm 120.

With the switches in the position shown in FIG. 5, which corresponds to the position of the elements shown in FIG. 3A, the camstack shaft 38 may be rotated to position the camstack for commencement of a cycle without arcing electrical contacts. When the door to the appliance has been closed, the door switches 204 are closed to enable completion of a start circuit. Upon depression of the push to start switch 220, in a manner similar to that described above with reference to FIG. 3B, current is directed through the switch 220 and the relay coil 234 to electrical ground. This current energizes the relay coil 234 causing the normally open relay contacts 208 to close. Provided the camstack has been manually rotated to a start position in an operational cycle, the cycle cam switch 210 is likewise closed. With the switches in these positions, the light is energized to indicate the appliance 10 is operating. Additionally, current flows through the timer motor 230 and the relay coil 234. This enables the timer motor to continue to operate and also continues to energize the relay so that the contacts 208 remain closed. As the camstack 78 rotates under the torque received from the timer motor 230, the motor cam switch 224 is selectively opened and closed by the action of the cam followers for the switches operating the drive motor and other components in the appliance 10. At the end of an operational cycle, the cycle cam switch 210 is opened. This causes the light to extinguish and current to no longer flow through either the timer motor 230 or the drive motor 228. Additionally, the relay coil 234 is no longer energized and the relay contacts 208 are opened again. The appliance 10 remains decoupled from the AC current source and in position for manual rotation of the camstack without significant risk of arcing contacts in the appliance. Once the camstack is rotated to a position that closes cycle cam switch 210 and the push to start switch 220 is depressed, the appliance commences another operational cycle.

One advantage of the electrical circuit with the push to start switch arrangement shown in FIG. 5 is the requirement to push switch 220 to continue an ongoing cycle once the cycle is interrupted by an open door. Specifically, if the door of a dishwasher, for example, is opened to put another article in a basket for cleaning, the electrical current through relay coil 234 would be interrupted. Subsequent closing of the door would not recommence operation of the appliance until the push to start switch 220 is operated to provide current to the light 214, the timer motor 230, and the relay coil 234. At that time, the relay coil would cause the relay contacts to 208 to close and current would then be supplied as explained above. Thus, the circuit arrangement and the push to start switch require more deliberate control to recommence operation of an appliance cycle. This type of appliance operation enhances the safety of the appliance.

The foregoing description is illustrative only, and is not intended to limit the scope of the invention to the precise terms set forth. Further, although certain illustrative embodiments have been described in detail, variations and modifications exist within the scope and spirit of the invention as described and defined in the following claims.

What is claimed is:

1. An apparatus, comprising:

a knob having an elongated actuator extending from a lower surface of the knob to an outboard end, the elongated actuator having a fin that terminates before the outboard end of the elongated actuator;

a camstack shaft for rotating a camstack used to selectively engage cam followers for controlling operation of an appliance cycle, the camstack shaft including a passageway for receiving the elongated actuator extending from the knob and the camstack shaft having a splines to receive the fin of the elongated actuator, the camstack shaft and the fin of the elongated actuator cooperating to enable rotational movement of the camstack;

a switch actuator having a hub and a radial flange, the hub engages the outboard end of the elongated actuator so the actuator is axially moved by depression of the knob;

a switch having one contact mounted on one end of a resilient member configured to urge the one contact toward another contact to close the switch; and a slider having a first end and a second end, the first end of the slider contacting the radial flange of the switch actuator and the second end of the slider being coupled to the resilient member of the switch so that depression of the knob moves the radial flange of the switch actuator with respect to the first end of the slider to urge the resilient member and the one contact away from the other contact to open the switch.

2. The apparatus of claim 1, the elongated actuator extending from the knob further comprising:

a shoulder between the outboard end of the elongated actuator and the fin, the elongated actuator having a first width from the knob to the shoulder and a second width, which is less than the first width, from the shoulder to the outboard end.

3. The apparatus of claim 2, the hub of the switch actuator further comprising:

an opening in the hub for receiving the outboard end of the elongated actuator up to the shoulder.

4. The apparatus of claim 3 further comprising:

a biasing member for urging the hub of the switch actuator against the shoulder of the elongated actuator extending from the knob.

5. The apparatus of claim 4 wherein the biasing member is a coiled spring concentrically mounted about an extension of the switch actuator hub.

6. The apparatus of claim 5, the resilient member to which the one contact of the switch is mounted further includes a tang; and the slider includes a coupler to which the tang is secured for uninterrupted engagement between the resilient member and the slider.

7. The apparatus of claim 6, wherein the other contact is mounted to a cam follower that follows a cam on the camstack.

8. The apparatus of claim 7, wherein the resilient member to which the one contact of the switch is mounted is a leaf spring.

9. The apparatus of claim 8, wherein the elongated actuator is resiliently coupled to the knob.

10. An apparatus, comprising:

a knob having an elongated actuator extending from a lower surface of the knob to an outboard end, the elongated actuator having a shoulder between the outboard end of the elongated actuator and the knob, and the elongated actuator also having a fin that terminates before the outboard end of the elongated actuator;

a camstack shaft for rotating a camstack used to selectively engage cam followers for controlling operation of an appliance cycle, the camstack shaft including a passageway for receiving the elongated actuator extending from the knob and the camstack shaft having a splines to receive the fin of the elongated actuator, the camstack shaft and the fin of the elongated actuator cooperating to enable rotational movement of the camstack;

a switch actuator having a hub and a radial flange, the hub having a passageway for receiving the outboard end of the elongated actuator up to the shoulder so the actuator is axially moved by depression of the knob;

a switch having one contact mounted on one end of a resilient member configured to urge the one contact toward another contact to close the switch; and a slider having a first end and a second end, the first end of the slider contacting the radial flange of the switch actuator and the second end of the slider being coupled to the resilient member of the switch so that depression of the knob moves the radial flange of the switch actuator with respect to the first end of the slider to urge the resilient member and the one contact away from the other contact to open the switch.

11. The apparatus of claim 10 further comprising:

a biasing member for urging the hub of the switch actuator against the shoulder of the elongated actuator extending from the knob.

12. The apparatus of claim 11 wherein the biasing member is a coiled spring concentrically mounted about the passageway that receives a portion of the elongated actuator.

13. The apparatus of claim 12, wherein the resilient member to which the one contact of the switch is mounted is a leaf spring.

14. The apparatus of claim 13, the leaf spring including:

a tang for coupling the leaf spring to the slider.

15. The apparatus of claim 14 further comprising:

a cam follower to which the other contact is mounted.

16. The apparatus of claim 15 wherein the elongated actuator is resiliently mounted to the knob.

* * * * *